United States Patent [19]

Ré

[11] 4,036,172

[45] July 19, 1977

[54] LIQUID APPLICATOR

[76] Inventor: Carlo Ré, 2947 N. Bristol St., Santa Ana, Calif. 92607

[21] Appl. No.: 688,144

[22] Filed: May 20, 1976

[51] Int. Cl.[2] ..... B05C 1/02

[52] U.S. Cl. ..... 118/262

[58] Field of Search ..... 118/261, 262, 202, 13

[56] References Cited

U.S. PATENT DOCUMENTS

| | | | |
|---|---|---|---|
| 2,503,858 | 4/1950 | Waterworth | 118/262 X |
| 2,517,263 | 8/1950 | Voorhies | 118/262 X |
| 2,714,365 | 8/1955 | Rowlands | 118/262 |
| 3,640,203 | 2/1972 | Raab et al. | 118/261 X |

*Primary Examiner*—John P. McIntosh
*Attorney, Agent, or Firm*—Keith D. Beecher

[57] ABSTRACT

Apparatus is provided for applying a thin film of liquid to a workpiece. Although the apparatus with be described as a convenient means for waxing skis, it will become apparent as the description proceeds that it has wider application. The apparatus includes a motor driven drum which is dipped in a pan containing the liquid to be applied to the workpiece, and which when rotated causes a coating of the liquid to adhere to the surface of the drum. A metering rod, which may be flat, round, or of any other appropriate shape, is supported on the surface of the drum in a position extending parallel to the axis of rotation of the drum. The metering rod has sufficient weight so that it does not turn with the drum but rests against a stationary support bracket which is mounted on the frame of the apparatus adjacent to the drum, and which also extends parallel to the axis of rotation of the drum. However, with a round metering rod, the metering would still be accomplished even if it rotated. The metering rod is shaped to define a predetermined space between its surface and the surface of the drum, and this space determines the thickness of the liquid coating adhering to the drum surface.

3 Claims, 3 Drawing Figures

LIQUID APPLICATOR

BACKGROUND OF THE INVENTION

Liquid applicators are known which comprise a rotatably driven drum which is dipped into a pan of liquid, so that the liquid will be drawn from the pan and onto the surface of the drum as the drum is rotated. The liquid on the surface of the drum can be applied to the workpiece, merely by holding the workpiece against the drum surface as the drum is rotating. Such applicators have been used, for example, for applying wax to skis, and they have a variety of other uses.

Difficulties have been encountered in the past in providing a metering means for controlling the thickness of the liquid coating on the drum surface which, in turn, determines the thickness of the film to be applied to the workpiece. A usual expedient in the prior art has been to mount a knife-blade or bar on a stationary support adjacent to the drum and extending parallel to the axis of rotation of the drum, the knife-blade or bar being displaced a predetermined distance from the drum surface. However, for accurate control of the thickness of the liquid coating on the drum by such a means, especially when the thickness is relatively small, the drum must be manufactured to be exactly round within critical tolerances, and the drive for the drum must be accurately and precisely centered. Such requirements can be met only by extremely expensive machinery.

In accordance with the concept of the present invention, the metering rod rests on the surface of the drum itself, rather than being mounted on a stationary support independent of the drum. The spacing between the metering rod and the drum in the apparatus of the present invention is determined by shoulders formed on the rod itself, and this spacing is independent of irregularities in the roundness of the drum or misalignments in the drive of the drum since it follows the drum as it rotates.

In the practice of the present invention, the thickness of the liquid coating on the drum can be maintained uniform, even where extremely thin coatings are involved, and even though the roundness of the drum and the precision of its drive do not conform to strict tolerances. By means of the concept of the present invention, a thin liquid coating of a predetermined thickness can be maintained on the surface of the drum, even though the applicator itself is relatively inexpensive.

Different liquid thicknesses on the drum can be achieved, in the applicator of the present invention, merely by providing a plurality of the aforesaid metering rods having shoulders of varying diameters relative to the diameters of the rods themselves.

DETAILED DESCRIPTION OF THE ILLUSTRATED EMBODIMENT

Figure 1:
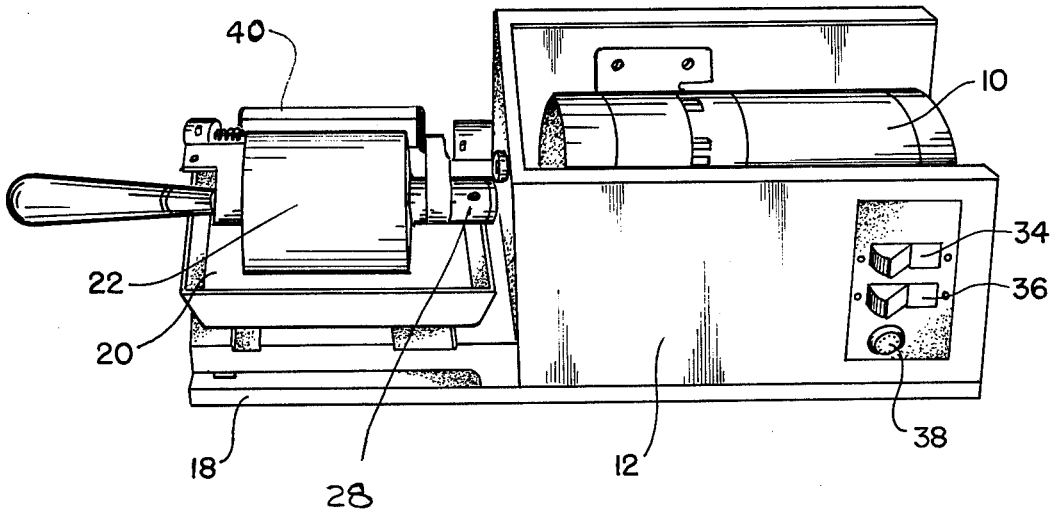
FIG. 1 is a perspective representation of a ski waxing machine constructed in accordance with the concepts of the present invention.
Figure 2:
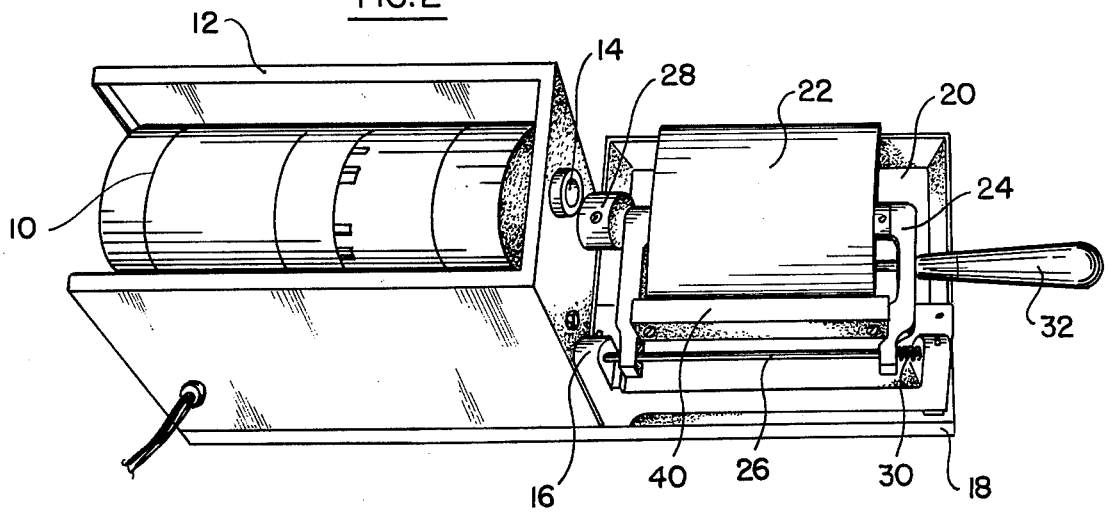
FIG. 2 is a further perspective representation of the machine of FIG. 1 taken from the opposite side.

The cover has been removed from the housing 12 of the machine of FIGS. 1 and 2 to reveal an electric motor 10 which is mounted within the housing. The motor 10 is mounted to the forward wall of the housing 12 by two screws 14 and 16 which extend through the housing wall and into the motor case, so that the motor may be rigidly and securely supported within the housing 12, without any tendency to turn, as torque is applied to the motor.

The housing 12 is supported on a frame 18 which also supports an open-topped pan 20. A drum 22 is rotatably supported on a bracket 24 which, in turn, is rotatably supported on a shaft 26, the shaft being mounted on the frame 18. A coupler 28 is provided which serves to couple the drum 22 to the drive shaft of the motor 10. The drum is held in a coupled relationship with the motor by a spring 30 which biases bracket 24 to the left in FIG. 2. A handle 32 is provided at one end of bracket 24.

To decouple the drum 22 from the drive shaft of motor 10, the handle 32 is pulled to the right in FIG. 2, so that the bracket 24 is moved against the action of spring 30. This pulls the coupler 28 out of its coupled relationship with the drive shaft of motor 10, and the drum 22 can then be turned up and out of the pan 20. The operation is reversed in order to couple the drum 22 to the drive shaft of motor 10, at which time the surface of the drum extends below the level of any liquid contained in pan 20.

A control panel is provided on the side of housing 12 which, as shown in FIG. 1, includes a switch 34 which turns the motor 10 off and on; and a switch 36 which controls a heating element in pan 20 which, in turn, controls the temperature of the liquid in the pan. A thermostat control 38 is also provided so that the liquid in the pan may be held at any desired temperature.

An elongated bracket 40 is mounted on bracket 24, the bracket 40 being spaced from the surface of drum 22, and extending parallel to the axis of rotation of the drum. A metering rod 42 is removably placed against bracket 40, and it also extends parallel to the axis of rotation of the drum 22. The metering rod rests on the surface of the drum, and it has sufficient weight, so that it continues to rest against the bracket 40 as the drum rotates.

Figure 3:
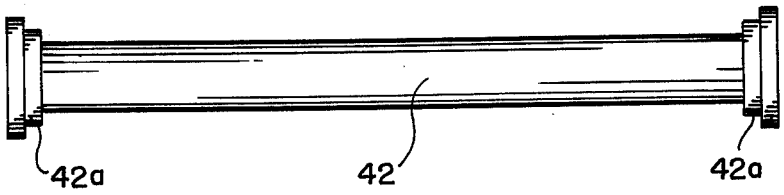
FIG. 3 is a representation of a metering rod which is used in the machine of FIGS. 1 and 2 to determine the thickness of the liquid coating on the applicator drum of the machine.

As shown in FIG. 3, the metering rod 42 has annular shoulders **42*a* at each end which rest on the surface of drum 22, and which determine the space between the rod and the surface of the drum. A pluraity of rods, such as rod 42 may be provided, with different size shoulders, so that a variety of different coating thicknesses may be obtained on drum 22**, as required.

It is evident that the thickness of the liquid coating on drum 22 as it is driven by motor 10 is determined by the metering rod 42. It is also evident that the metering rod follows any irregularities in the surface of drum 22, and any misalignments in the drive of the drum, so that the thickness of the coating on the drum is not dependent upon tolerances in the drum construction or in its drive.

As described, the metering bar need not necessarily be round, and it can have any appropriate shape, even that of sheet metal, or the like. The present invention involves the concept of the metering bar, regardless of its shape, carried by the drum, with the drum acting as a cam and with the shoulders on the metering bar acting as cam followers.

Since the drum surface is normally flexible, a single metering bar could be used, and selected pressures, or weights, could be applied to the bar to force the shoulders into the material of the drum for different desired film thicknesses.

The invention provides, therefore, a simple and inexpensive mechanism, whereby liquid coatings may be achieved of any desired thickness on an applicator drum, and which need not be constructed to precise tolerances.

While a particular embodiment of the invention has been shown and described, modifications may be made. It is intended in the claims to cover the modifications which come within the spirit and scope of the invention.

What is claimed is:

1. A liquid applicator comprising: a drum; a mounting bracket rotatably mounting said drum and exposing an upper portion of said drum to permit a workpiece to be held against said drum to enable said drum to apply a liquid to the workpiece; a pan of liquid mounted on said mounting bracket under said drum in position such that the surface of said drum is below the surface of the liquid in said pan when the applicator is operational for applying a liquid coating to the surface of said drum; and a rod supported on the surface of said drum and extending parallel to the axis of rotation of the drum for controlling the thickness of the liquid coating applied to the surface of the drum, said rod having shoulders at each end thereof and an uninterrupted surface between shoulders, said shoulders determining the space between the uninterrupted surface of the rod and the surface of the drum, and said space determining the thickness of the liquid coating on the surface of the drum.

2. The liquid applicator defined in claim 1, and which includes an elongated bracket mounted on said mounting bracket and extending parallel to the axis of rotation of said drum and displaced from the surface of said drum, and in which said rod is removable and rests against said bracket.

3. The liquid applicator defined in claim 1, in which the cross-section of said rod has a round configuration, and said rod has annular shoulders at each end thereof.

* * * * *